United States Patent [19]

Winker

[11] 4,351,397

[45] Sep. 28, 1982

[54] VIBRATING RIPPER

[75] Inventor: Bernard L. Winker, Prospect, Ill.

[73] Assignee: International Harvester Co., Chicago, Ill.

[21] Appl. No.: 129,448

[22] Filed: Mar. 10, 1980

[51] Int. Cl.[3] ..... A01B 61/00

[52] U.S. Cl. ..... 172/464; 172/484; 172/497; 267/35; 92/84

[58] Field of Search ..... 172/484, 490, 699, 202, 172/801, 500, 483, 497, 498, 501, 464, 502, 816, 254, 474; 267/35, 153, 64 B, 63 A, 63 R; 92/13.6, 13.7, 13.8, 84, 134

[56] References Cited

U.S. PATENT DOCUMENTS

| | | | |
|---|---|---|---|
| 2,300,192 | 10/1942 | Allen | 172/464 X |
| 3,238,647 | 3/1966 | Hall | 172/816 |
| 3,265,380 | 8/1966 | Hall | 172/816 |
| 3,279,105 | 10/1966 | Kolinger | 172/816 |
| 3,461,971 | 8/1969 | Sprenkel | 172/710 |
| 3,494,745 | 2/1970 | Buckstead | 37/8 |
| 3,503,456 | 3/1970 | Larson | 172/484 |
| 3,539,018 | 11/1970 | Sprenkel | 172/484 |
| 3,561,539 | 2/1971 | Evans | 172/484 |
| 4,013,129 | 3/1977 | Wilkinson | 172/484 |
| 4,029,157 | 6/1977 | Freese | 172/816 |
| 4,031,964 | 6/1977 | Takahashi | 172/484 |
| 4,044,838 | 8/1977 | Wooldridge | 172/484 |
| 4,133,392 | 1/1979 | Freese | 172/816 |

FOREIGN PATENT DOCUMENTS

| | | | |
|---|---|---|---|
| 960105 | 3/1957 | Fed. Rep. of Germany | 172/464 |
| 1029849 | 5/1958 | Fed. Rep. of Germany | 172/464 |
| 293960 | 1/1972 | U.S.S.R. | 172/699 |

*Primary Examiner*—Richard J. Johnson
*Attorney, Agent, or Firm*—J. W. Gaines; F. D. AuBuchon

[57] ABSTRACT

A vibrating ripper having quadrilateral linkage. The linkage, equipped with a remote hydraulic control therefor for making running adjustments as afforded by a depth actuator cylinder during ripping and possibly, but not necessarily, as afforded by a pitch actuator cylinder which also can be provided, has a raised-carry position and a lowered-rip position in which it has a vibratory rocking action, and defines a pitch axis fixed in the linkage and shifting therewith during depth changes. Strategic upper level placement of an elastic strut connection which is provided, and diagonal placement of the lift or depth cylinder connection to the draft frame or to the ripper beam and shank assembly, locate the pitch axis at the node of the rocking assembly as it vibrates.

5 Claims, 5 Drawing Figures

FIG. 3
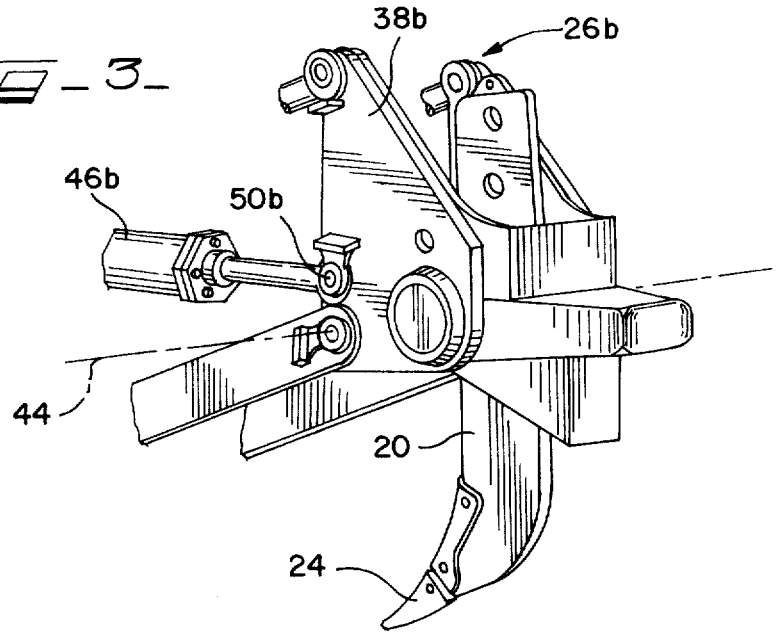
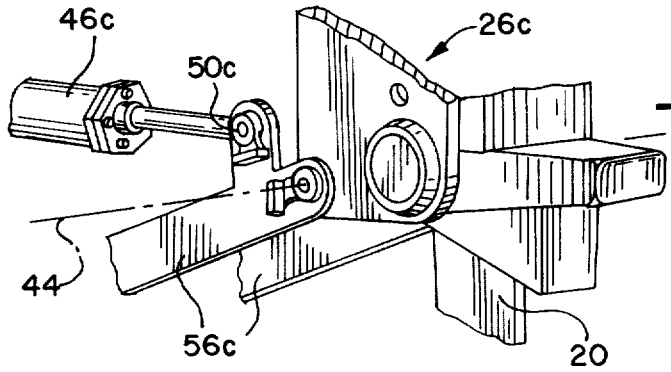
FIG. 4
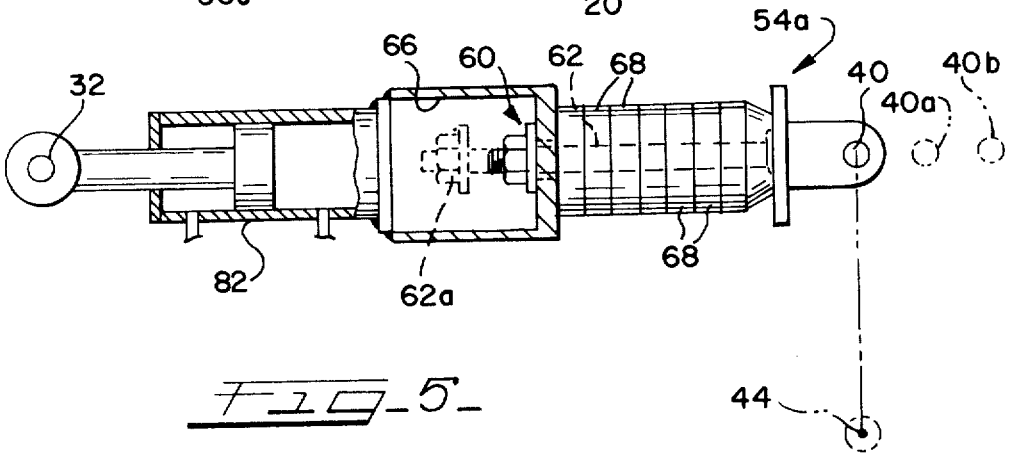
FIG. 5

VIBRATING RIPPER

This application is a companion case to U.S. Pat. No. 4,013,129, owned by the same assignee; the patent disclosure is incorporated in entirety herein by reference.

My invention relates to a single or multi-cylinder mounting for tractors to support, at the rear thereof, a ripper, more particularly a toothed vibrating ripper.

In a ripper-shank-carrying quadrilateral linkage for attachment to tractors, the imparting of a vibrating motion to the ripper shank while it is suspended by the linkage from the tractor offers numerous advantages. Such motion affords a most desirable way of fracturing rock encountered during ripping, especially when the linkage is accommodative of horizontal vibratory ripper tooth motion along the line of rip. More important is the potential lessening of high-impact shock forces into the tractor structure, again when the freedom to vibrate is horizontally for "give" in the rip direction.

It is an object, through the use of the present invention as an attachment for a tractor, to provide a quadrilateral linkage ripper with a vibrating capability along the above lines. More specifically, my linkage, equipped with a remote hydraulic control therefor for making running adjustments as afforded by a depth actuator cylinder during ripping and possibly, but not necessarily, as afforded by a pitch actuator cylinder which also can be provided, has a raised-carry position and a lowered-rip position in which it has a vibratory rocking action, and defines a pitch axis fixed in the linkage and shifting up and down therewith relative to a lift axis. Strategic upper level placement of an elastic strut connection which is provided, and strategic diagonal placement of the lift or depth cylinder connection to the draft frame or to the ripper beam and shank assembly, locate the pitch axis at the node of the rocking assembly as it vibrates.

Perforce, the vibratory tooth motion is horizontal and preferably, but not essentially, neither vibration nor adjustment of pitch can cause changes in depth adjustment of the ripper tooth, and adjustments in depth change neither the pitch adjustment nor the angular attitude of the flat arc of tooth vibration.

Background patents include, but are not limited to U.S. Pat. Nos. 3,238,647, 3,279,105, 3,265,380, 3,492,745, 3,503,456, 4,031,964 and a specifically noted German Pat. to Cordes No. 960,105/1957, even though direct relevance is found lacking.

The latter, now expired foreign patent to Cordes lacks the basis essential for concluding that it would have ever received consideration by one skilled in the art working on the pertinent problem to which my invention pertains. Cordes discloses a ripper linkage locked at the pitch axis and vibrating, if at all, up and down after the manner of a raidal ripper linkage. The only reasonable expectation for a skilled man's conclusion to be drawn from Cordes is that an elastic upper strut when horizontally disposed is what is conducive to vibratory tooth motion in the vertical direction rather than the rock fracturing horizontal vibratory tooth motion provided by my invention. There is nowhere in Cordes or elsewhere any appreciation shown for Cordes's problem.

Without the drawbacks and disadvantages of power-operated ripper tooth vibrators, my invention with the utilization of a particular geometry and critical component selection and placement needs rely only on, and acts somewhat as the stimulus to, self-excited vibrations in the desired horizontal direction of the ripper's motion, as will now be explained in detail.

Features, objects, and advantages will either be specifically pointed out or become apparent when, for a better understanding of my invention, reference is made to the following description, taken in conjunction with the accompanying drawings which show certain preferred embodiments thereof and in which:

FIGS. 3 and 4 are left side, three quarters view somewhat similar to FIG. 1 but showing respective modified embodiments of my invention; and FIG. 5 is a modification more versatile than the somewhat simplified embodiment of FIG. 2 which also appears in FIG. 1.

Figure 1:
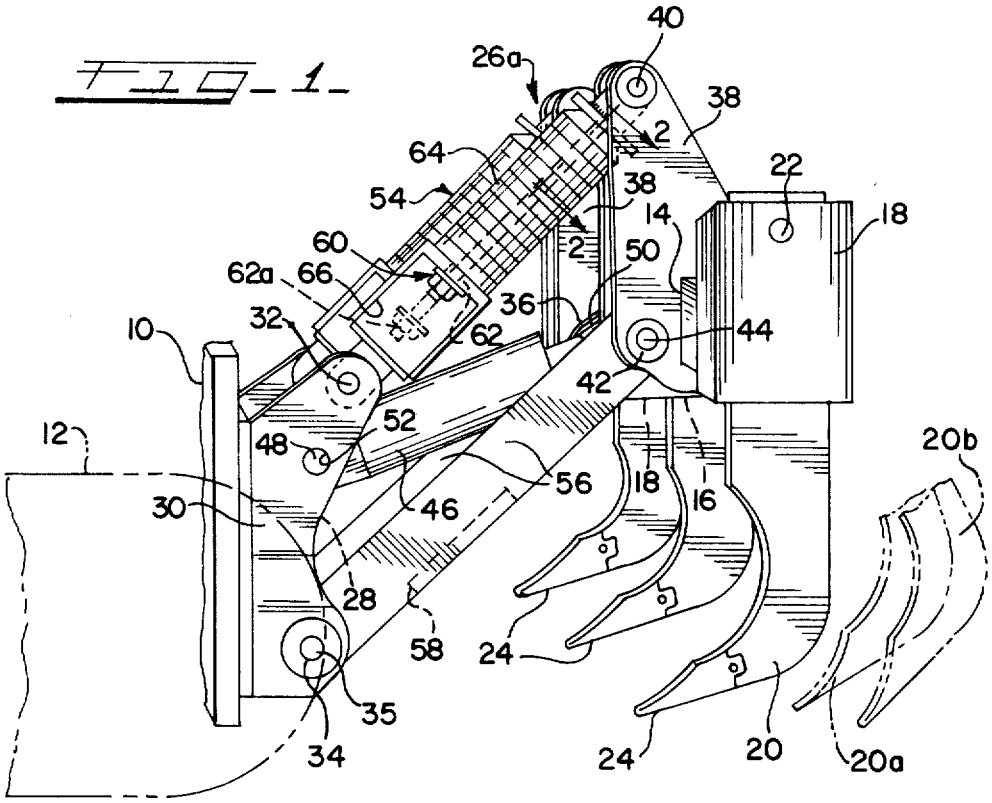
FIG. 1 is a left side perspective view of a crawler tractor carrying the attachment according to my invention.

More particularly in FIG. 1 of the drawings, a tractor 10 having conventional left and right crawler tracks 12 carries a transversely disposed horizontal tool beam 14 at the rear. The beam is of generally square cross section and includes a box-shaped central shank holder 16 and left and right shank holders 18. The shanks of individual rippers 20 are secured by cross pins 22 in the individual holders, and are sharp tipped at the front for penetration into the ground by reason of carrying replaceable ripper teeth 24 at the bottom of the ripper.

The foregoing tool beam 14 and shank holders 16 and 18 are integrated together to constitute a ripper shank assembly **26*a*, and means is provided to support the shank assembly in positions at the rear of the tractor 10 including a raised-carry position for the rippers 20** as shown in solid lines in FIG. 1, and an infinity of unshown intermediate positions and an extreme lowered-rip position for the rippers.

Illustrative of one such positioning-support means is a draft frame linkage including a central mounting clevis 28 and two identical symmetrical vertical mounting towers 30 attached by bolts to a vertical support plate on the rear of the tractor 10. The arrangement is such that the clevis 28 with the two towers 30 outboard thereof generally occupies a common vertical reference plane therewith, transverse to the tractor 10 and its line of ripping movement.

The towers 30 have upper pivots 32 outwardly and upwardly offset in the reference plane from the mounting clevis 28. The towers also have lower pivots 34 spaced apart in the reference plane from the mounting clevis 28 and rendering the latter medially offset and also offset upwardly therefrom at a height at least a major part, and preferably about three-fourths of the vertical distance from, the height of the tower lower pivots 34 to the height of the tower upper pivots 32. The lower pivots 34 in their coaxial relationship to one another define the lift axis 35 serving as a reference axis below and above the level of which the beam 14 is lowered and raised.

The ripper shank assembly **26*a* at its front further includes, at the center, an inner front clevis 36 integral with the central shank holder 16 of the tool beam 14, and two vertically disposed brackets 38 affixed rigidly to the beam 14 at points intermediate the inner clevis 36 and the shank holder 18 forming each end of the beam 14. Each beam bracket 38 has an upper pivot 40 outwardly and upwardly offset from the beam shank holder clevis 36, and a lower pivot 42 outwardly offset from, and together with, the beam shank holder clevis 36 establishing a mutual pitch line defining the ripper pitch axis 44. The former noted upper pivots 40** on the beam bracket constitute the pitching connection to control the ripper shanks.

Linkage now to be described interconnecting the tractor 10 and shank assembly 26*a* consists, briefly, of respective elastically compressible upper strut links and draft frame links forming varying length and fixed length members pinned together as an adjustable quadrilateral.

More specifically between and interconnecting the central mounting clevis 28 and beam inner clevis 36, which are spaced in fore-and-aft alignment with one another ahead of the beam 14, single hydraulic depth actuator means is provided, similarly in alignment therewith and extending generally downwardly and rearwardly so as to pivot on clevis 36. While the size and cost of a single actuator could be offset by utilization of horizontally paired clevises 28 in closely spaced adjacency, horizontally paired clevises 36 in closely spaced adjacency, and horizontally paired depth actuator cylinders 46 in closely spaced adjacency, the depth actuator means actually illustrated is a diagonally disposed, single lift cylinder 46 having a front pin 48 connecting the cylinder at its head end to the mounting clevis 28 and a rear pin 50 connecting the cylinder at its piston rod end to the central inner clevis 36 which is front mounted on and integral with the tool beam 14 as described. The front pin 48 is in the transverse vertical reference plane previously mentioned, and the tower 30 at each outer side of the attachment is formed with an access hole 52 horizontally aligned in the reference plane with the pin 48. The pin 48 has the smaller diameter, for installation and removal of same through either axis hole without interference.

The single depth actuator cylinder 46 is in the vertical plane containing the longitudinal central axis of the tractor 10.

Between and interconnecting the tower lower pivot 34 at each side of the tractor and beam bracket lower pivot 42, which are spaced in fore-and-aft alignment with one another, a draft link 56 of fixed length is provided having a draft plate 58 integral therewith and with the companion draft link 56 on the other side of the tractor.

In the specific arrangement described, novelty is felt to reside in the following, which are provided between and interconnect the tower upper pivot 32 at each side of the tractor and beam bracket upper pivot 40, which are in spaced fore-and-aft alignment with one another. More particularly, individual upper struts 54 are provided, each with an elastically compressible and lost motion connection 60 included therein and having its head end at the front supported by the pivot 32 thereat and having its rod end at the rear supported by the pivot 40 thereat.

A resulting pair of quadrilateral linkages at the sides of the tractor includes therein the pair of upper struts 54 with connections 60 as the respective upper links, the pair of beam brackets 38 as rear links, the fixed-predetermined-length pair of draft links 56 as lower links, and the pair of towers 30 as the fixed front links. Utilization of upper struts 54 selected so as to be slightly longer from the length as shown in FIG. 1, will result in the quadrilateral linkages becoming true parallelograms in fore-and-aft extending, parallel vertical planes; thereupon, in the mode sometimes desired, the rippers 20 will maintain the same ripping angle to the earth at all depths therein to which they are set by the depth actuator cylinder 46.

Ripping as a term is used in the sense that underground obstacles are ripped out and surface paving is ripped up, and a furrow is ripped in the ground and along the earth's surface. To do so the present ripper is pulled by the tractor 10 to penetrate and to upset and move obstacles and earth formation and man-made formation. That is to say the ripper teeth 24 go beneath the surface upon which the tractor is operating and break through and fracture the rock in formations to a certain depth as the tractor moves forward. Considerable traction is employed and considerable power is applied because of the high and seemingly constantly varying resistance encountered when pulling along the submerged teeth 24.

The variably but heavily loaded teeth 24 tend to vibrate horizontally in their own vertical plane which is the plane of rip, and the connection 60 forming a section of each upper strut 54 actively participates in exciting horizontal tooth vibration.

More particularly, a long through-bolt 62 passed through an elastically compressible section 64 takes a broken line position 62*a* so as always to accommodate compressive loads and consequent foreshortening of each upper strut 54 from the strut's fully extended length as illustrated. A hollow piston-shaped, cylindrical end portion 66, which carries the strut from mounting eye, unobstructively and slidably receives in the piston head portion the inwardly projecting through-bolt 62 in its lost motion manner as the bolt protrudes further inwardly. However, at point of and as soon as the strut's fully extended length is restored by spring-back of the released elastic section 64, each strut 54 becomes inextensible because the bolt 62 as a tension member bottoms in the end portion 66 so that the strut has in effect fixed length to tension loads.

Heavy duty means of known construction is provided in the elastic section 64 of each upper strut, as will now be explained.

RUBBER-LIKE CONICAL SPRINGS—FIG. 2

Illustrative of one such means in this figure is an aligned internested stack of rubber-like conical springs 68 each including a pair of rings 70, 72 which are bonded to a metallic base 74. The number of these coaxial springs 68 can be varied to obtain the desired elasticity, travel, and spring back frequency.

The bolt 62 has a head 76 anchored in a cap portion 78 carrying the strut rear mounting eye, not shown. A bottoming nut 80 is initially adjusted on a threaded end of the bolt 62 so that the assembled parts of the elastic and lost motion connection 60 are firmly held in place.

OPERATION—FIG. 1

Figure 2:
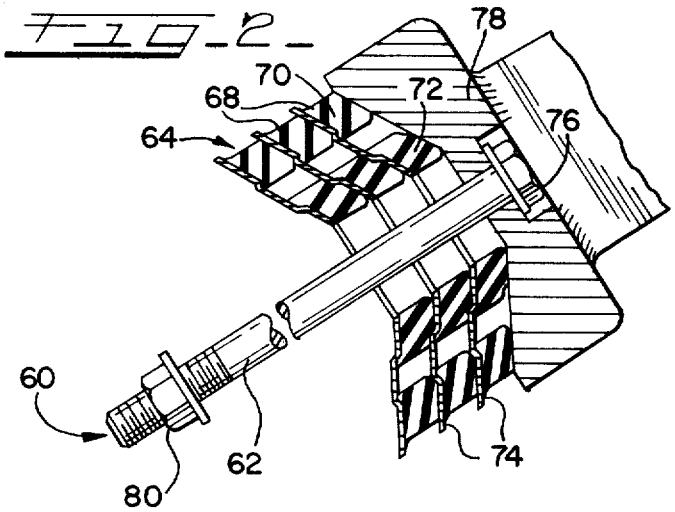
FIG. 2 is a longitudinal sectional view showing an elastic detail as taken along the section line II—II in FIG. 1.

Although FIG. 1 does not illustrate the shanks 20 actually located below the soil level corresponding to their lowered-rip position, the vibration mode can readily be gathered by considering the illustrated broken line ripper position 20*a* and its frontward solid line position 20 to define the vibrational displacement points taken at full amplitude from the intervening home or undisplaced position of vibration, not shown. This horizontal vibratory tooth action due to the correspondingly desired reaction of the elastic and lost motion connection 60 sets up in the beam brackets 38 and the rear portion of the linkage assembly a rocking motion; it is critical to the geometry involved in this embodiment to have the pitching pivot 40, so as to react forces into the rubber-like conical springs 68 (FIG. 2), in a substantially spaced location from the pitch axis 44 for proper leverage, and to have the pin 50 which is the fixed pivot for the rear of the actuator cylinder 46 to be coaxial with the pitch axis 44, thereby precisely locating the pitch axis at the node of the rocking assembly as it vibrates.

Thus, the ripper teeth 24 are spaced apart below and vertically from the horizontal fixed pitch axis 44 and their amplitude of vibration is perforce limited to flat arc, fore and aft horizontal vibrations.

Essentially the same relationship obtains when a snag or the rock or obstruction ordinarily fractured by vibration introduces an extraordinarily high impact, forcing the rippers 20 to "give" in an elastically cushioned way (the take-up is in the rubber-like conical springs 68, FIG. 2) and to take an extreme rearward deflection of the ripper as shown by the broken line position **20*b***. This capability to deflect substantially reduces the high impact shock force to which the ripper assembly would otherwise be subjected. The rear of the tractor will rise slightly as the ripper with a self-lifting extricating motion rides elastically up and over whatever is snagging.

Means is provided for depth setting with the pair of actuators repositioned outboard if desired, but a slight binding or mechanical interference can be encountered and there will be some sacrifice in the desired direct lift pull exerted on the tool beam, all because of a lack of precise geometry attainable.

LIFT CYLINDER PIVOT ON BRACKET—FIG. 3

Illustrative of one such means in the embodiment of this figure, a modified ripper shank assembly **26*b* has each depth actuator cylinder 46*b* in the vertical plane of the associated outboard quadrilateral and connected by the piston rod end thereof with its rear pivot pin 50*b* on the beam bracket 38*b* spaced closely adjacent to but above the pitch axis 44. Horizontal vibrations of the single ripper 20 tend to interfere with the depth set by the cylinder 46*b*; so as to accommodate, the horizontal vibratory tooth motion at 24 if of sufficient amplitude will deviate from simple horizontal motion because the beam brackets 38*b*** will tend to transfer slightly up and down in position as they rock in vibrating.

The modification **26*b*** is shown in a lowered-rip position.

Another form the invention can take similarly enables the pair of depth actuators to be outboard, but a disadvantage arises in that bending moments will be introduced into the draft frame, and the desired direct pull will no longer be exerted on the tool beam by the lift cylinders.

LIFT CYLINDER PIVOT ON DRAFT FRAME—FIG. 4

Illustrative of one such form of the invention, as embodied according to this figure, a modified ripper assembly **26*c* is arranged with each of the depth actuator cylinders 46*c* in the vertical plane of the associated outboard quadrilateral and with their piston rod ends connected with the rear pivot pin 50*c* of each cylinder carried on an upstanding arm rigid with the fixed length draft frame link 56*c*. Because the single ripper 20 extends to a point below and vertically aligned with the horizontal pitch axis 44 of the assembly 26*c*, and because the cylinders 46*c* fix the axis 44** horizontally and vertically relative to the tractor, the vibratory tooth action is horizontal in the direction of rip.

The modification of FIG. 4 is shown with the assembly **26*c*** in a lowered-rip position.

With constant angle ripping, a difficulty sometimes encountered during a raising operation is that the points of the teeth 24 move toward the tractor 10 and wedge intervening slabs and boulders between themselves and the tractor. So for remotely releasing such wedged-in slabs and boulders, and also more generally for varying the pitch angle of the points for optimum ripping angle according to material ripped, it is often appropriate to re-set the assembly hydraulically to establish a different rip angle for the ripper teeth.

My vibrating ripper assembly readily adapts to consolidating in the upper struts thereof a pair of pitch cylinders for a compound action as will now be explained.

HYDRAULIC DEPTH ADJUSTMENT AND PITCH ADJUSTMENT—FIG. 5

In the embodiment of the invention as shown in this figure, the modified multi-sectional upper strut link **54*a* at each side of the ripper assembly is connected at its piston rod end thereinto by its front pivot pin 32 being anchored in the upper pivot on the associated control tower, not shown. The strut 54*a* is connected at the rear by the upper pivot 40 to the top of the associated beam bracket, not shown, so as to be connected above and generally vertically aligned with the ripper pitch axis schematically shown at 44**.

The elastic and lost motion connection 60 in the compressible section of the strut limits extension of the strut in that section because of the relatively inextensible bolt 62 after all lost motion is taken up, and reacts to compressive loads elastically because of the action of rubber-like conical springs 68 in each upper strut. That section is preferably located outboard.

An inboard section of the strut **54*a* consists of a pitch actuator cylinder 82 axially in tandem with the outboard section. Specifically, the cylinder 82 is welded to a metal cap forming the hollow cylindrical end portion 66 of the outboard section in a way not to interfere with inward sliding movement of the bolt 62 into the latter. Accordingly, the overall strut length can be foreshortened and extended by operation of and hydraulic locking of the cylinder 82 so as to shift the pitching axis and beam bracket upper pivot 40 defining same into various positions of displacement such as the positions shown by the broken lines 40*a* and by the broken lines 40*b*. The ripper teeth, not shown, will therefore take permanently adjusted pitch angle positions about their pitch axis 44** as the center.

As viewed in terms of the internal mechanical connections of its interacting elements, the strut link **54*a* is seen to have the bolt 62 thereof serving as an inextensible section connected mechanically in parallel with the second section with nonmetallic conical springs 68 therein and, together therewith, being connected mechanically in series with the third or actuator section occupied by the pitch cylinder 82**.

Viewing the embodiment **54*a* within the complete environment which is not repeated but which appears fully in FIG. 1, one can see that the remotely-operated depth actuators afford convenience to the driver in making running adjustments by changing the depth of rip while the tractor continues operating. And when the depth actuator sets the ripper in the previously referred to position of raised-carry or slightly below, the pitch actuator cylinders 82 are a decided convenience because the driver can hydraulically foreshorten the actuators 82 as viewed in FIG. 5, rotate the beam brackets counterclockwise about the beam pitch axis 44**, and thereby provide an increase in angular penetration of the tooth of the ripper.

Or, when the depth actuator sets the ripper in an operating position above or actually in the previously referred to lowered-rip position and the ripper point fully snags or hangs up on a boulder, the driver again finds it convenient, as a matter of easy extrication, to foreshorten the pitch actuator cylinders 82 again, rotate the beam brackets in the same counterclockwise direction about the beam pitch axis 44 (FIG. 5), and thereby move the snagged ripper tooth, not shown, rearwardly to facilitate removal of all ripper teeth from the ground.

The fundamental endo-ecto difference in purpose between sections in the guiding strut member can be broken down to be that the pitch-change action of the cylinder 82 internally adjusts the pitch, whereas the series-connected elastically compressible section 68 is what adjusts to external pitch changes from vibration and heavy impact from snags.

Although the rippers, here shown variously in raised-carry and lowered-rip positions, appear as three-shank rippers or one-shank rippers throughout, it is evident my invention applies equally to N-shank rippers, including five-shank vibrating rippers.

The actuators described are remotely actuated by the driver from the seat of the tractor, by means of hand valves, not shown, and a conventional hydraulic system with separate connections for pitch and depth control. The pitch actuators have coordinated operation characterized by foreshortenable movement to the same shortness in unison, extensible movement to the same length in unison, and immobility hydraulically locked at the same length; the depth actuators have a similar coordinated operation with one another.

Variations within the spirit and scope of the invention described are equally comprehended by the foregoing description:

1. A vibrating ripper assembly to swingably suspend ripper teeth shanks from vertical support plate means carried by, and across the rear of, a tractor, comprising:

attachment means for attachment to the vertical support plate means (10) on the tractor; and quadrilateral linkage means affixed at a relatively inner end thereof to stationary swing connections (32, 34) on the attachment means for swinging movement by the linkage means of the relatively outer end portion thereof, said swinging outer end portion having vertically spaced-apart pitching and pitch axis swing connections (40, 42) linking same in the quadrilateral linkage means, and further having means of suspending ripper teeth shanks (20) from said swinging outer end portion;

said quadrilateral linkage means having an upper link member (54*a*) pivoted to the vertically spaced relatively upper swing connection to render the same the pitching connection, and including, as link sections therein, a pitch actuator cylinder section (82) effective at the just said connection to internally adjust pitch of the linkage means and angle of tooth action about the pitch axis (44) swing connection, and a co-aligned series-connected elastically compressible (68) section of stocked conical springs effective at the pitching connection (40) to yieldably adjust to external pitch changes from horizontal vibratory tooth action about the pitch axis swing connection (42).

2. The invention of claim 1 wherein the upper link member (54*a*) is characterized by including, as a further link section thereof:

a lost motion section (62) connected in alignment in the link member in parallel with the elastically compressible section and, together therewith, connected in alignment in series with the pitch actuator cylinder (82) section and arranged so that, following any foreshortening motion of the lost motion section in the upper link member as afforded by the elastically compressible (68) section therein, the lost motion section will discontinue subsequent re-extension as soon on the re-take as it takes up the lost motion.

3. A vibrating ripping assembly for mounting ripper teeth shanks for generally parallelogram-linkage movement behind vertical support plate means (10) carried by, and across the rear of, a tractor, said vibrating ripping assembly comprising:

a generally transversely disposed tool beam (14) for the ripper teeth shanks;

attachment means for attachment to the vertical support plate means on the tractor comprising a pair of vertical towers (30);

a pair of laterally spaced apart, pivoted quadrilateral linkages to adjustably suspend the tool beam with respect to the vertical support plate means comprising the pair of towers (30) as the front members, and each linkage further comprising a vertical rear member forming a carrying bracket (38) on said beam, an upper link member (54) pivotally connected at opposite ends to the tops of the respective front vertical tower and rear vertical beam bracket members, and a lower link member (56) secured at one end to the bottom of the rear vertical beam bracket member to establish a pitch line for the beam and ripper teeth, and secured at one end to the bottom of the front vertical tower member for fixing a lift axis below and above the level of which the beam is lowered and raised;

said upper link members including therein compressible elastic sections (68) to afford yieldable foreshortening of the upper link members jointly; and generally diagonally connected depth actuator means (46) secured to the attachment means and inclining therefrom generally downwardly and rearwardly to beam clevis means (36) for pivotally connecting to the beam so as to fix the pitch line of the beam and ripper teeth as a joint coaxis (44) therewith, whereby the fixed joint coaxis defines the node for ripping oscillations caused by horizontal vibratory tooth action along the line of rip and jointly reacted to by the compressible elastic sections (68) as they accommodate to consequent foreshortening and re-extension of the upper link members.

4. For use in vibratory ripping with a traction vehicle moving a quadrilateral ripper assembly therebehind, having generally vertical ripper beam brackets forming the links of the quadrilateral at the rear, the improvement in said quadrilateral ripper assembly comprising:

sets of pivots at the respective upper corners of the quadrilateral including upper pivots (32) for anchored attachment to the rear of the vehicle and upper pivots (40) carried by the vertical brackets forming the rear links of the quadrilateral;

dynamically elastic link means completing the quadrilateral (30, 56, 38, 54) as the upper quadrilateral links thereof, said links each having tandem piston means therein in alignment spaced apart one from another and one consisting of an hydraulic piston (in cylinder 82) and another a vibratory piston (66);

hydraulic cylinder means consolidated in said link means to hydraulically lock the hydraulic piston (in cylinder 82) fixing the quadrilateral upper links at desired nominal lengths effective in the quadrilateral; and multiple conical elastic elements consolidated in a stack (64) in said link means against each vibratory piston therein to initially deflect therewith and thereafter elastically sustain the vibrations set up thereby in the quadrilateral upper links.

5. For use in vibratory ripping with a traction vehicle moving, therebehind, a quadrilateral ripper assembly having generally vertical ripper beam brackets forming the links of the quadrilateral at the rear, the improvement in said quadrilateral ripper assembly comprising:

sets of pivots at the respective upper corners of the quadrilateral including upper pivots (32) for anchored attachment to the rear of the vehicle and upper pivots (40) carried by the vertical brackets forming the rear links of the quadrilateral;

dynamically elastic bar means completing the quadrilateral (30, 56, 38, 54) as the upper quadrilateral links thereof, said links each having tandem piston means therein in alignment spaced apart one from another and one consisting of an hydraulic piston (in cylinder 82) and another a vibratory piston (66);

hydraulic cylinder means consolidated in said bar means to hydraulically lock the hydraulic piston (in cylinder 82) fixing the quadrilateral upper links at desired nominal lengths effective in the quadrilateral;

sets of lower pivots (35, 42) at the respective lower corners of the quadrilateral including lower pivots (42) carried by the vertical brackets forming the rear links of the quadrilateral and defining a pitch axis (44); and multiple conical elastic elements consolidated in a stack (64) in said bar means against each vibratory piston therein to initially deflect therewith and thereafter elastically sustain the vibrations set up thereby in the quadrilateral upper links, whereby said bar means are forced into serving the dual function as the necessary upper links in the quadrilateral and as the source of elastic sustaining the vibrations as set up, and whereby said lower pivots are forced into serving the dual function to define the necessary pitch axis (44) in the quadrilateral and at least to approximate the node point of the vibrations being set up and sustained.

* * * * *